US007455600B2

(12) United States Patent
Imamoto et al.

(10) Patent No.: US 7,455,600 B2
(45) Date of Patent: Nov. 25, 2008

(54) GOLF CLUB HEAD

(75) Inventors: Yasunori Imamoto, Tokyo (JP); Hisashi Yamagishi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 502 days.

(21) Appl. No.: 11/233,143

(22) Filed: Sep. 23, 2005

(65) Prior Publication Data

US 2006/0100032 A1 May 11, 2006

(30) Foreign Application Priority Data

Nov. 5, 2004 (JP) ..... P2004-322510

(51) Int. Cl.
*A63B 53/04* (2006.01)

(52) U.S. Cl. ..... 473/345; 473/347; 473/349; 473/335

(58) Field of Classification Search ..... 473/324–350, 473/287–292
See application file for complete search history.

(56) References Cited

U.S. PATENT DOCUMENTS

| | | | | |
|---|---|---|---|---|
| 3,652,094 | A | 3/1972 | Glover | |
| 3,976,299 | A * | 8/1976 | Lawrence et al. | 473/327 |
| 4,021,047 | A | 5/1977 | Mader | |
| 4,432,549 | A | 2/1984 | Zebelean | |
| 4,438,931 | A | 3/1984 | Motomiya | |
| 5,205,560 | A | 4/1993 | Hoshi et al. | |
| 5,255,913 | A | 10/1993 | Tsuchida | |
| 5,547,427 | A | 8/1996 | Rigal et al. | |
| 5,570,886 | A | 11/1996 | Rigal et al. | |
| 5,624,331 | A | 4/1997 | Lo et al. | |
| 5,669,827 | A | 9/1997 | Nagamoto | |
| 5,766,095 | A | 6/1998 | Antonious | |
| 5,967,904 | A | 10/1999 | Nagai et al. | |
| 5,997,415 | A | 12/1999 | Wood | |
| 6,010,411 | A | 1/2000 | Reyes | |
| 6,089,992 | A | 7/2000 | Onuki et al. | |

(Continued)

FOREIGN PATENT DOCUMENTS

| | | | |
|---|---|---|---|
| JP | 4-89071 | A | 3/1992 |

(Continued)

OTHER PUBLICATIONS

Japanese Office Action dated Nov. 2, 2006 issued in JP Patent Application No. 2002-178798.

(Continued)

*Primary Examiner*—Sebastiano Passaniti
(74) *Attorney, Agent, or Firm*—Sughrue Mion, PLLC

(57) ABSTRACT

A hollow golf club head includes a face portion, a sole portion, a side portion, a crown portion and a hosel portion. A main portion of the crown portion is made of a fiber plastic resin. At least the face portion, a front edge portion of the crown portion continuous with the face portion, and a central portion of the sole portion in a toe-heel direction are made of a metal. A loft angle is in a range of 14° to 25°. A head volume is in a range of 100 cc to 230 cc. A weight of a fiber plastic resin portion of the golf club head is in a range of 6% to 30% of a weight of the golf club head.

11 Claims, 7 Drawing Sheets

U.S. PATENT DOCUMENTS 6,162,130 A 12/2000 Masumoto et al.
6,162,132 A * 12/2000 Yoneyama ..... 473/338
6,248,025 B1 6/2001 Murphy et al.
6,254,494 B1 7/2001 Hasebe et al.
6,332,847 B2 12/2001 Murphy et al.
6,340,337 B2 1/2002 Hasebe et al.
6,354,962 B1 3/2002 Galloway et al.
6,354,963 B1 3/2002 Kodama et al.
6,368,230 B1 * 4/2002 Helmstetter et al. ..... 473/244
6,371,868 B1 4/2002 Galloway et al.
6,381,828 B1 5/2002 Boyce et al.
6,406,378 B1 6/2002 Murphy et al.
6,435,977 B1 8/2002 Helmstetter et al.
6,435,978 B1 8/2002 Galloway et al.
6,440,008 B2 8/2002 Murphy et al.
6,440,011 B1 8/2002 Hocknell et al.
6,471,604 B2 10/2002 Hocknell et al.
6,491,592 B2 12/2002 Cackett et al.
6,524,194 B2 2/2003 McCabe
6,524,198 B2 2/2003 Takeda
6,527,650 B2 3/2003 Reyes et al.
6,575,845 B2 6/2003 Galloway et al.
6,582,321 B2 6/2003 Galloway et al.
6,582,323 B2 6/2003 Soracco et al.
6,602,149 B1 8/2003 Jacobson
6,607,452 B2 8/2003 Helmstetter et al.
6,620,056 B2 9/2003 Galloway et al.
6,623,378 B2 9/2003 Beach et al.
6,648,774 B1 11/2003 Lee
6,676,536 B1 1/2004 Jacobson
6,739,982 B2 5/2004 Murphy et al.
6,739,983 B2 * 5/2004 Helmstetter et al. ..... 473/342
6,739,984 B1 5/2004 Ciasullo
6,872,152 B2 3/2005 Beach et al.
6,945,876 B2 9/2005 Nakahara et al.
7,344,452 B2 * 3/2008 Imamoto et al. ..... 473/345
2001/0049310 A1 12/2001 Cheng et al.
2002/0160858 A1 10/2002 Lee
2003/0083151 A1 5/2003 Nakahara et al.
2003/0125127 A1 7/2003 Nakahara et al.
2003/0134692 A1 7/2003 Nakahara et al.
2003/0134693 A1 7/2003 Nakahara et al.
2004/0005936 A1 1/2004 Imamoto et al.
2004/0009830 A1 * 1/2004 Nishio ..... 473/345
2004/0116208 A1 6/2004 DeShiell et al.
2004/0266551 A1 12/2004 Noguchi et al.
2005/0020379 A1 * 1/2005 Kumamoto ..... 473/332
2006/0063608 A1 3/2006 Mori et al.

FOREIGN PATENT DOCUMENTS

JP 05-068725 3/1993
JP 06-039941 2/1994
JP 7-406 U 1/1995
JP 7-112041 A 5/1995
JP 07-112042 A 5/1995
JP 07-155410 6/1995
JP 08-024377 1/1996
JP 09-038250 2/1997
JP 09-187534 7/1997
JP 09-215786 8/1997
JP 09-322953 12/1997
JP 10-015119 1/1998
JP 11-319167 A 11/1999
JP 2000-024149 A 1/2000
JP 2000-033133 2/2000
JP 2000-167090 A 6/2000
JP 2003-320060 11/2000
JP 2001-062003 A 3/2001
JP 2001-087426 A 4/2001
JP 2001-149514 A 6/2001
JP 2001-309998 A 11/2001
JP 2001-321474 A 11/2001
JP 2001-340499 12/2001
JP 2002-000773 A 1/2002
JP 2002-011122 1/2002
JP 2002-224249 8/2002
JP 2003-062130 3/2003
JP 2003-144590 5/2003
JP 2003-205055 A 7/2003
JP 2004-016654 A 1/2004
JP 2004-065810 3/2004
JP 2004-180759 7/2004
WO WO 2004/052472 A1 6/2004

OTHER PUBLICATIONS

Japanese Office Action dated Jan. 22, 2007 issued in JP Patent Application No. 2002-178798.
Japanese Office Action dated May 8, 2007 issued in JP Patent Application No. 2002-178798.

* cited by examiner

GOLF CLUB HEAD

BACKGROUND OF THE INVENTION

1. Field of the Invention

The present invention relates to a hollow golf club head, and more particularly to a golf club head of a fairway wood type or having a shape similar thereto.

2. Description of the Related Art

As wood-type golf club heads such as drivers and fairway woods, hollow metallic heads are widely in use. Generally, the hollow wood-type golf club head has a face portion for hitting a ball, a crown portion constituting an upper surface portion of the golf club head, a sole portion constituting a bottom surface portion of the golf club head, a side portion constituting side surface portions on the toe side, the rear side, and the heel side of the golf club head, and a hosel portion. A shaft is inserted in this hosel portion, and is fixed by an adhesive agent or the like. It should be noted that golf clubs called utility clubs are also commercially available in large numbers, and various golf clubs having a head similar to the aforementioned wood-type golf club head (i.e., having the face portion, the sole portion, the side portion, the crown portion, and the hosel portion) are also commercially available.

As metals for forming this hollow golf club head, aluminum alloy, stainless steel, and a titanium alloy are used, and the titanium alloy, in particular, has come to be used widely in recent years.

It is possible to enlarge the sweet spot by increasing the volume of the hollow golf club head. To prevent the weight of the golf club head from increasing as a consequence of the increase in the volume, it has been conceived to adopt a fiber plastic resin whose specific gravity is far smaller than the aforementioned metals. In this case, since the face surface for hitting a ball needs to be made of a metal to ensure the strength, portions other than the face portion are made of the fiber plastic resin.

For example, US 2004/0005936 A1 discloses a golf club head adopting the carbon fiber reinforced thermosetting resin (CFRP).

SUMMARY OF THE INVENTION

The invention provides a fairway wood golf club head in which the weight of the fiber reinforced resin portion is appropriate.

According to one embodiment of the invention, a hollow golf club head includes a face portion, a sole portion, a side portion, a crown portion and a hosel portion. A main portion of the crown portion is made of a fiber plastic resin. At least the face portion, a front edge portion of the crown portion continuous with the face portion, and a central portion of the sole portion in a toe-heel direction are made of a metal. A loft angle is in a range of 14° to 25°. A head volume is in a range of 100 cc to 230 cc. A weight of a fiber plastic resin portion of the golf club head is in a range of 6% to 30% of a weight of the golf club head.

According to this structure, the weight of the fiber reinforced resin is appropriate. Therefore, the golf club head is easy to swing.

A front edge portion of the side portion and a front edge portion of the sole portion may be made of a metal and be continuous with the face portion. A metal portion of the sole portion extends to a rear face portion of the golf club head. A first weight member made of a metal may be disposed at a rear portion thereof.

A weight of the first weight member may be in a range of 10% to 25% of the weight of the golf club head.

According to this structure, the first weight member is disposed in the rear portion, so that the depth of the center of gravity is large.

A sole-face side of the first weight member may be covered with a metal or a resin.

According to this structure, since the first weight member is covered with the metal or the resin, it is possible to enhance the aesthetic appearance of the sole portion.

A second weight member may be disposed on an inner surface of the metal portion of the sole portion, be in front of the first weight member, and be closer to a toe side than a halfway portion of the sole portion in the toe-heel direction.

According to this structure, since the second weight member is disposed, the degree of freedom in designing the center of gravity and the moment of inertia of the golf club head is high.

A third weight member may be disposed inside the fiber plastic resin portion on a toe side or be disposed to be in contact with the fiber plastic resin portion.

The third weight member may have a thin-plate shape and be embedded in the fiber plastic resin constituting the side portion on the toe side.

The third weight member may be made of a rubber or a synthetic resin containing powder of a metal.

According to this structure, since the third weight member is disposed on the toe side, the sweet area of the golf club head becomes large in the toe-heel direction.

Also, according to this structure, the weight member can be firmly attached to the side portion formed of the synthetic resin.

Also, according to this structure, the third weight member can easily be shaped in conformity to the side portion.

The metal portion constituting the golf club head may be formed of a face plate made by forging or press molding. The remaining portion of the golf club head may be formed of a forged piece. The face plate is fixed to the forged piece.

A thickness of the face plate in a vicinity of a central portion of thereof may be larger than that of a peripheral edge portion thereof.

According to this structure, it is possible to increase the repulsion of the face portion.

The weight of the golf club head may be in a range of 215 g to 240 g.

According to this structure, the golf club head has appropriate weight as a fairway wood golf club.

DETAILED DESCRIPTION OF THE EMBODIMENTS

Figure 1:
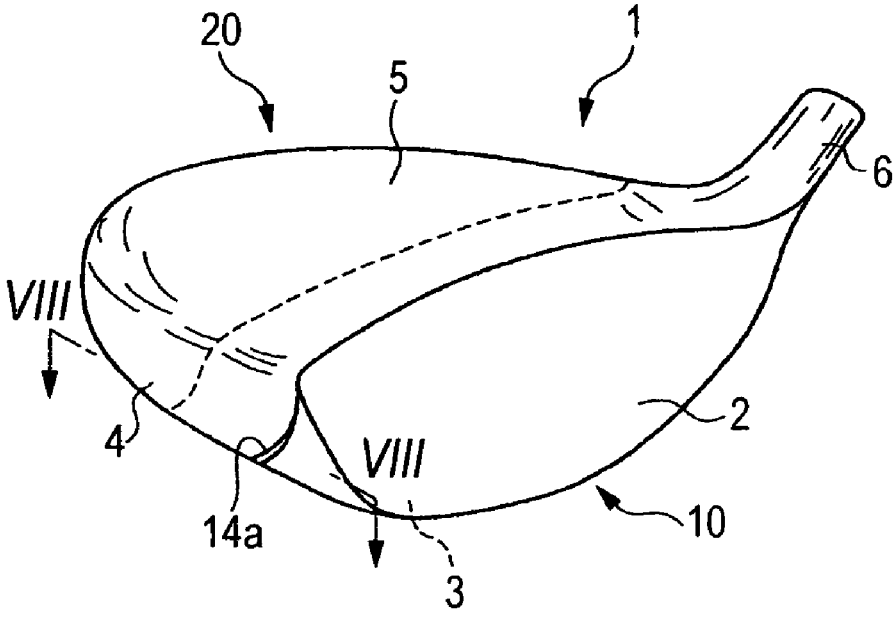
FIG. 1 is a perspective view of a golf club head according to an embodiment.
Figure 2:
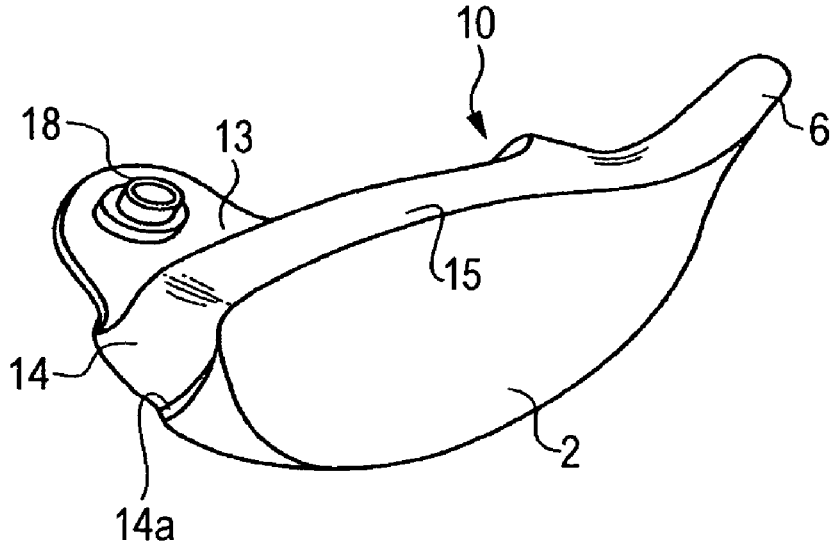
FIG. 2 is a perspective view of a metal body of the golf club head shown in FIG. 1 as viewed from the front side thereof.

Hereafter, a description will be given of the embodiments of the invention with reference to the drawings.

This golf club head 1 is a hollow fairway wood-type golf club head having a face portion 2, a sole portion 3, a side portion 4, a crown portion 5, and a hosel portion 6.

The face portion 2 is a surface for hitting a ball, and is formed with grooves (score lines), which are not shown. The sole portion 3 constitutes a bottom portion of the golf club head. The side portion 4 constitutes side surface portions on the toe side, the heel side, and the rear surface side. The crown portion 5 constitutes an upper surface portion of the golf club head. A shaft is inserted into the hosel portion 6. The shaft is secured by means of an adhesive agent.

This golf club head 1 includes a metal body 10 and a fiber-plastic-resin body (hereafter referred to as the FRP body) 30.

The metal body 10 has the face portion 2, a metal sole portion 13, a metal side portion (toe) 14, a metal crown portion 15, a metal side portion (heel) 16, recesses 17 respectively formed on the toe side and the heel side of a front portion of the metal sole portion 13, an annular member 18 provided in the rear of the metal sole portion 13, and the hosel portion 6.

The metal crown portion 15, which constitutes a front edge portion of the crown portion 5, is continuous with the metal side portion (toe) 14 and the metal side portion (heel) 16. The metal side portion (toe) 14 and the metal side portion (heel) 16 are respectively continuous with the metal sole portion 13. The metal crown portion 15, the metal side portions 14 and 16, and the metal sole portion 13 are continuous with the face portion 2.

A front portion of the metal sole portion 13 extends over an entire width of the golf club head from the toe side to the heel side. The width of this metal sole portion 13 becomes gradually narrow from the front portion toward the rear portion. The rear portion of the metal sole portion 13 is disposed at a central portion of the golf club head in the heel-toe direction.

Figure 7A:
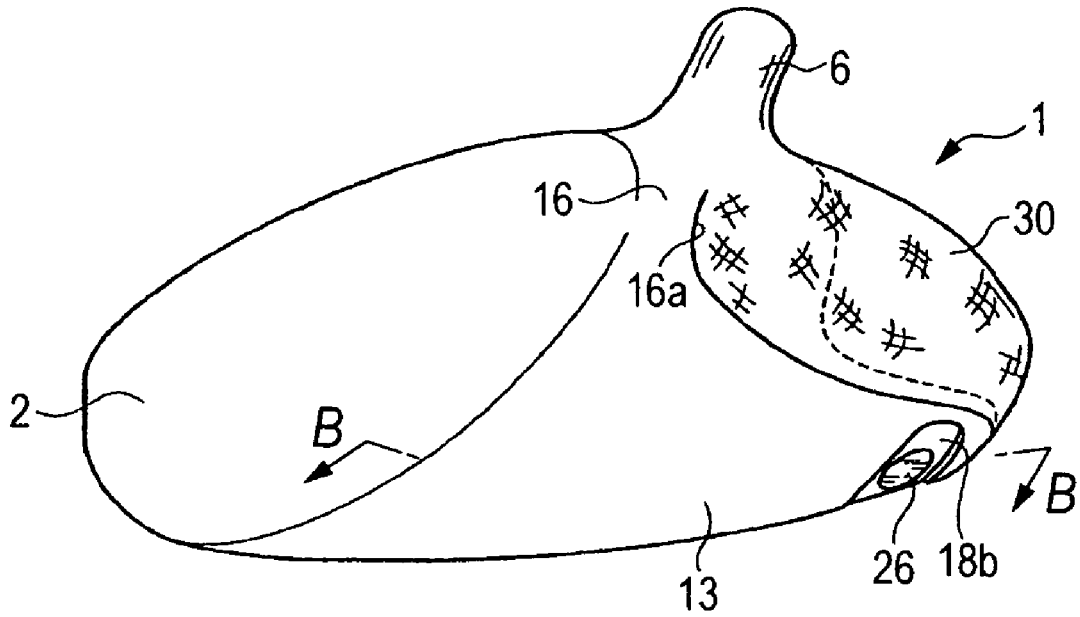
FIG. 7A is a perspective view of the golf club head as viewed from the sole side thereof.
Figure 7B:
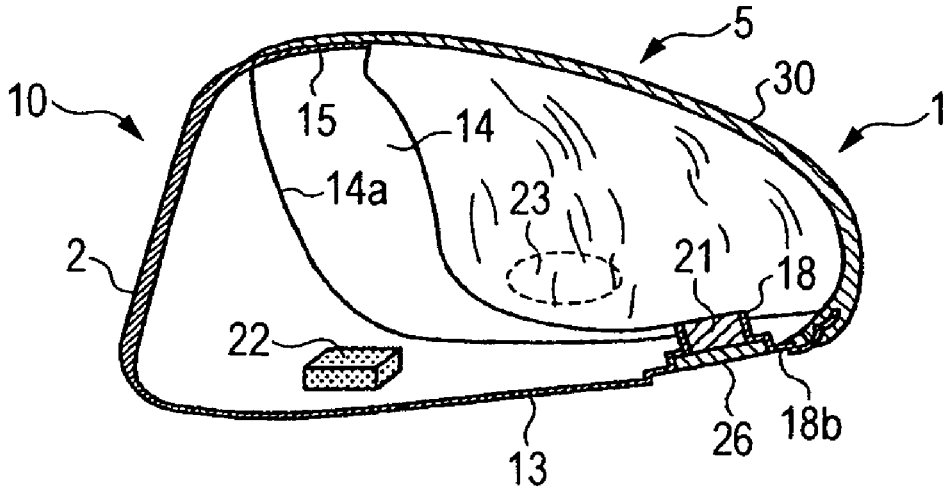
FIG. 7B is a section view taken along line B-B in FIG. 7A.
Figure 8:
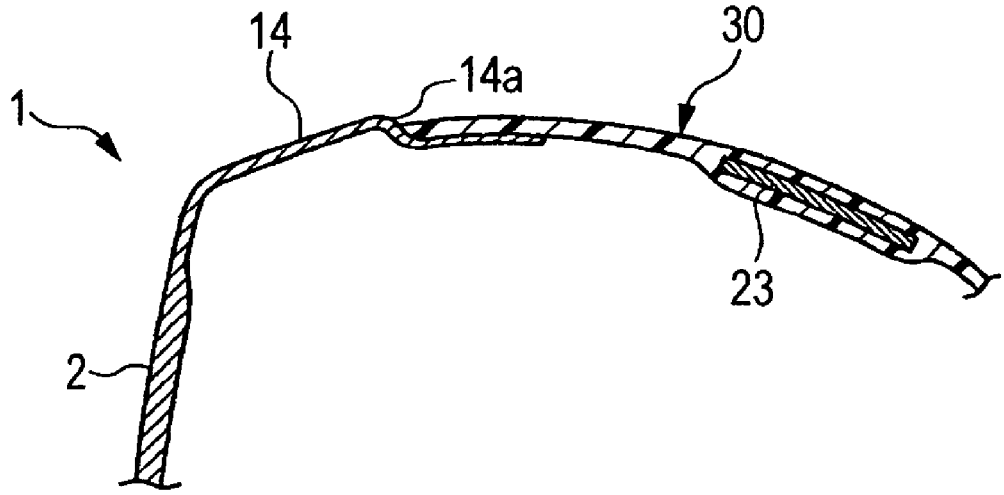
FIG. 8 is a section view taken along line VIII-VIII in FIG. 1.

The rear portion of the metal sole portion 13 rises up rearward obliquely. The annular member 18 is integrated with the rear portion of this metal sole portion 13. An internal thread (not shown) is formed on an inner peripheral surface of the golf club head, and a screw-shaped first weight member 21 made of a high-specific-gravity metal is screwed thereinto, as shown in FIGS. 7 and 8. The metal sole portion 13A is formed with a first annular recessed portion 18*a* surrounding the annular member 18 and a second annular recessed portion 18*b* surrounding the first annular recessed portion 18*a*. A circular plate 26 made of aluminum is fitted and fixed into this first annular recessed portion 18*a* by interference fit or the like.

Although not shown, the face portion 2 is constituted of a face plate formed by forging or press molding. The remaining portion of the metal body 10 is fabricated by forging. As for the forged piece, an opening is formed in its face portion, and the face plate is fitted into this opening and is secured by caulking, welding, or the like.

The face portion 2 is configured to have high repulsion, with the thick central portion and the thin peripheral edge portion.

The FRP body 30 constitutes the remaining portion of the outer surface of this golf club head 1. Namely, the FRP body 30 has a size for making up substantially the entirety of the crown portion 5, a rear half portion of the side portion 4, and a portion of the sole portion 3 other than the metal sole portion 13.

As shown in an enlarged form in FIGS. 7 and 8, the FRP body 30 is in close contact with outer surfaces of edge portions of the metal sole portion 13 as well as outer surfaces of the metal crown portion 15 and the metal side portion 14 (both on the toe and heel sides).

In the crown portion, the FRP body 30 extends to the vicinity of a frontmost edge of the upper surface of the metal crown portion 15. On the heel side and the sole side of the side portion, stepped portions 14*a* and 16*a* are formed on the metal body 10, and the FRP body 30 reaches these stepped portions 14*a* and 16*a*. It should be noted that the stepped portions 14*a* and 16*a* are steps where the rear side is recessed. These stepped portions 14*a* and 16*a* extend rearwardly along the side edges of the metal sole portion 13, and are continuous with each other at the rear edge of the metal sole portion 13.

Figure 3A:
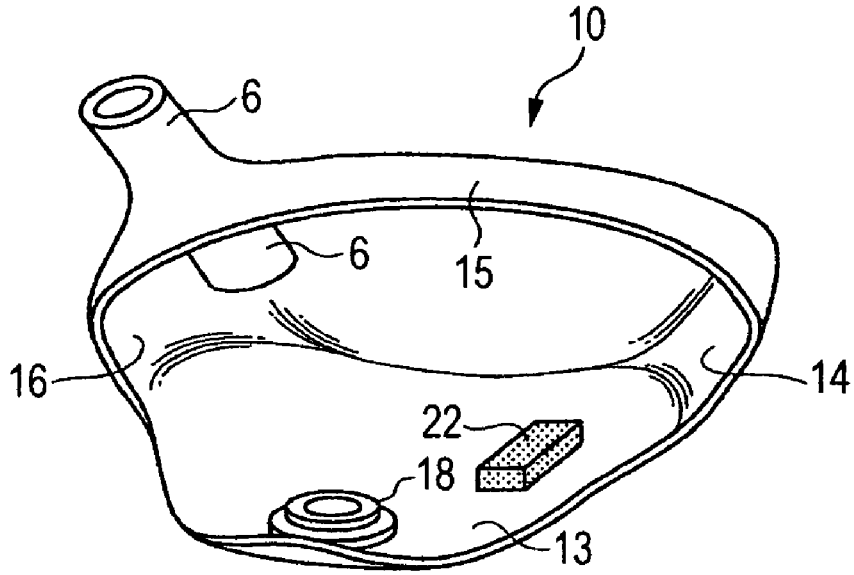
FIGS. 3A and 3B are perspective views of the metal body of the golf club head shown in FIG. 1 as viewed from the rear side thereof.
Figure 3B:
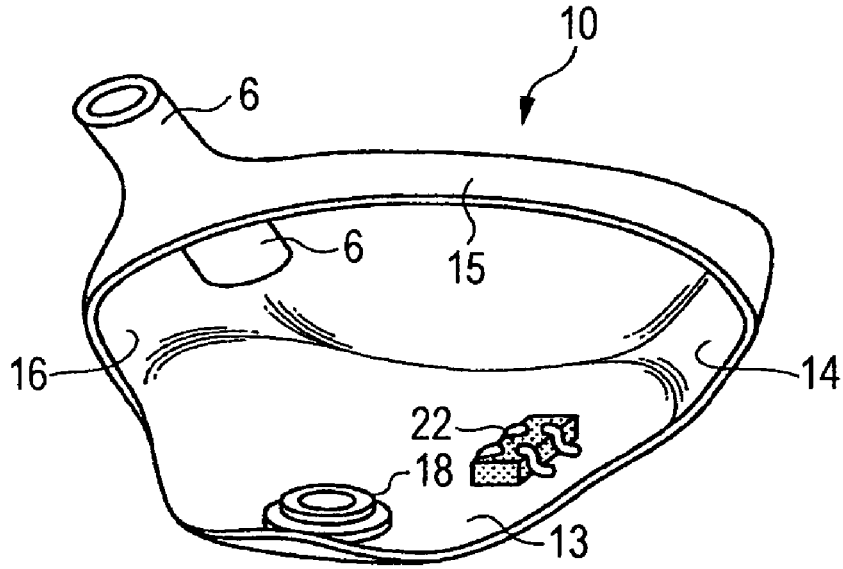
Figure 4:
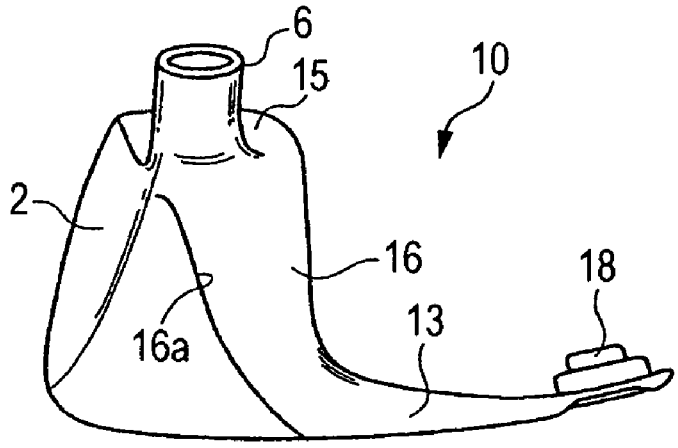
FIG. 4 is a side view of the metal body of the golf club head shown in FIG. 1 as viewed from the heel side thereof.
Figure 5:
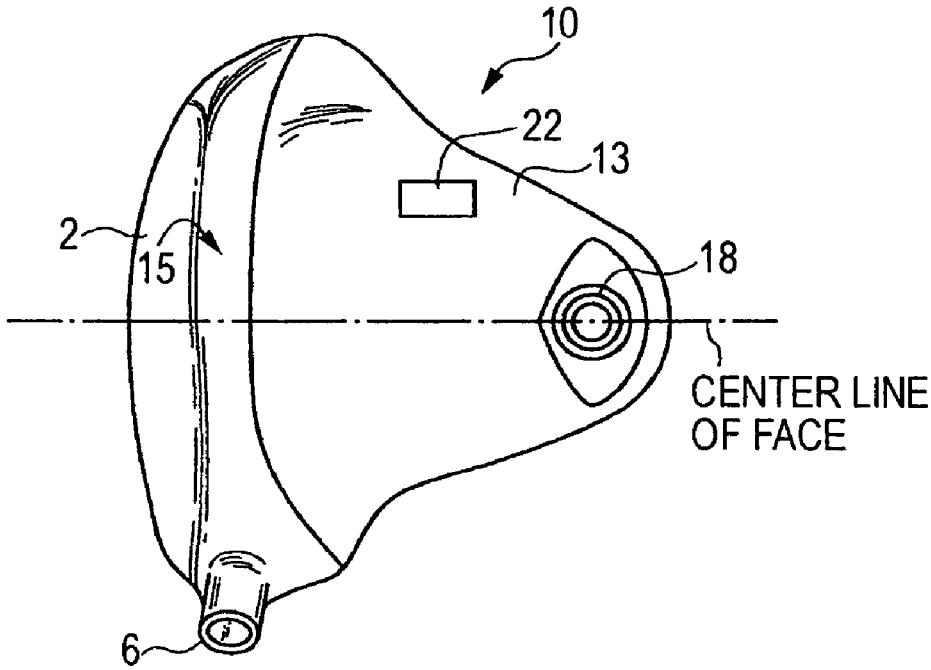
FIG. 5 is a plan view of the metal body of the golf club head shown in FIG. 1.
Figure 6A:
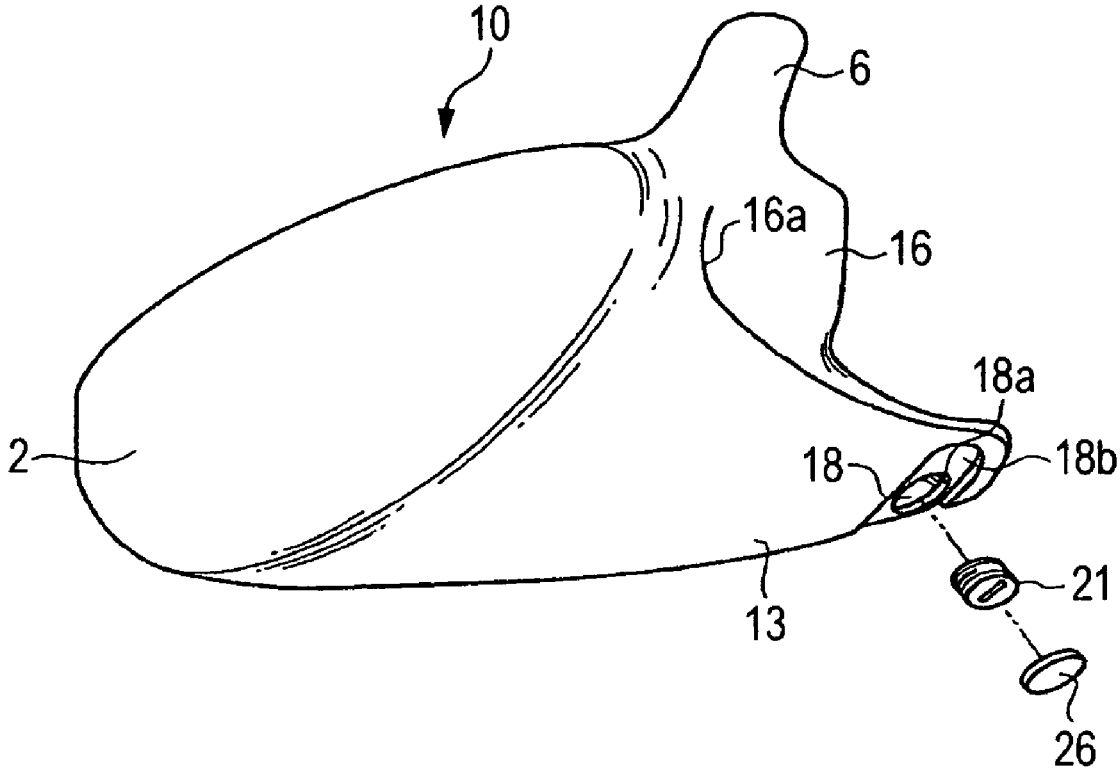
FIG. 6A is a perspective view of the metal body 10 as viewed from the sole side thereof.
Figure 6B:
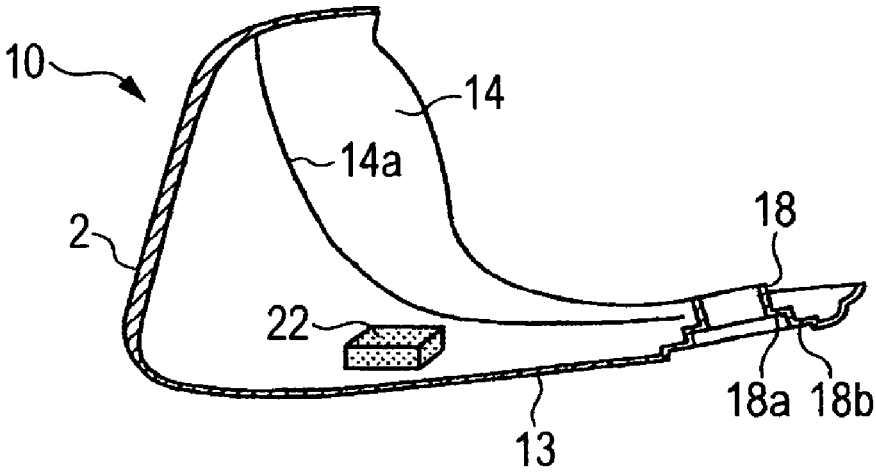
FIG. 6B is a section view taken along line B-B in FIG. 6A.

On an inner surface (upper surface) of the metal sole portion 13, a second weight member 22 made of a high-specific-gravity metal is secured in front of the first weight member 21 and closer to the toe side than the halfway portion in the toe-heel direction. This second weight member 22 is preferably secured firmly by welding, as shown in FIG. 3A. Alternatively, pawls may be provided uprightly from the metal sole portion 13, and the second weight member 22 may be held by these pawls, as shown in FIG. 3B. These pawls may be secured with a molten metal by means of a welding rod so as to surround the second weight member 22, or may be retrofitted with a molten metal of the welding rod.

A third weight member 23 is embedded in the side surface of the FRP 30 on the toe side. This third weight member 23 is preferably made of rubber or a synthetic resin containing powder of a high-specific-gravity metal. In particular, if the second weight member 22 is disposed in the rear of the shaft axis and closer to the toe side than the face center, a position opposite to the hosel portion disposed above the heel side becomes heavy, which makes it possible to optimize the position of the center of gravity. Therefore, this arrangement is favorable. It is preferable that the third weight member is similarly disposed in the rear of the toe side.

To form and integrate this FRP body 30 with the metal body 10, a mold having the shape of an outer configuration of the golf club head is prepared. A first prepreg sheet (an uncured resin-fiber composite sheet) in which the fibers are oriented in two orthogonal directions is laid along the inner surface of the mold. This first prepreg sheet is laid at a position for covering the entire outer surface of the FRP body 30.

Next, a plurality of second prepreg sheets in which fibers are oriented in one direction are laminated on this first prepreg sheet. The plurality of second prepreg sheets are laminated so that the directions of the fibers become alternate. In the course of this lamination, the third weight member 23 is sandwiched between the prepreg sheets making up the side portion on the toe side.

Next, the metal body 10, to which the second weight member 22 has been secured but the first weight member 21 and the circular plate 26 have not been fitted, is placed in the mold.

Thereafter, the golf club head is heated while gas pressure is being applied to the inside of the golf club head through the opening of the annular member 18, for curing the resin. At this time, a resin bag made of nylon or the like may be placed in advance inside the golf club head, and a gas may be supplied into this bag to inflate it, thereby allowing the prepreg sheets to be pressed and brought into close contact with the inner surface of the mold.

Consequently, the FRP body 30 is formed, and the peripheral edge portion of the FRP body 30 is brought into close contact with the metal body 10, as shown in FIG. 7. The third weight member 23 is embedded in the side portion of this FRP body 30 on the toe side, as shown in FIG. 8.

After completion of molding, the mold is released, and a vibration absorbing layer and a hitting-sound adjusting layer are formed on the inner surface of the golf club head, if necessary. For example, if an adhesive agent including polyisobutyrene or the like is formed in a layered state, it is possible to prevent the golf club head from making rattling noise.

Next, the first weight member 21 is screwed into the annular member 18, and then the metal plate 26 made of aluminum or the like is fitted and secured into the first annular recessed portion 18*a*. Subsequently, polishing and painting are performed, if necessary, with respect to the outer surface of this golf club head, thereby obtaining a golf club head product.

In this golf club head 1, the loft angle is preferably in a range of 14° to 25°, more preferably 15° to 21°, and the head volume is preferably in a range of 100 cc to 230 cc, more preferably 110 cc to 220 cc. The weight of the FRP body 30 and the metal body 10 (including the weight members 21 and 22) is preferably determined so that the weight of the FRP body 30 becomes 6% to 30%, preferably 7% to 25%, more preferably 15% to 20%, of the total weight of the golf club head 1.

As a constituent material of the metal body 10 other than the weight members, a titanium alloy, stainless steel, maraging steel, a copper alloy, a zirconium alloy, or the like is suitable, especially, a titanium alloy such as Ti-6Al-4V is suitable.

It should be noted that in the case where the face plate is forged or press molded, a titanium alloy (particularly β type) such as Ti-6Al-4V, Ti-15V-3Cr-3Sn-3Al, and T-22V-4Al is preferable as its material. It should be noted that it is possible to increase strength and hardness of the β type titanium alloy by heat treatment after plastic working.

In the case where forging is carried out, investment forging is suitable. It is preferable to perform vacuum forging or centrifugal forging to ensure that molten metal reaches up to thin-walled portions sufficiently.

The first and second weight members are suitably formed of tungsten or a tungsten alloy having a specific gravity of 10 or greater, preferably 12 or greater.

The third weight member is suitably formed of rubber or a synthetic resin containing powder of such a high-specific-gravity metal. The specific weight of the third weight member is preferably in a range of 10 to 17, more preferably 13 to 15. As this synthetic resin, a thermoplastic synthetic resin such as nylon is preferable. The nylon resin, in particular, is preferable since the dispersion of the metal powder is excellent. When the FRP 30 is molded, the third weight member formed of rubber or a thermoplastic synthetic resin becomes soft by being subjected to heat, so that a shape thereof conforms to the inner surface of the mold.

The specific gravity of the third weight member as a whole is preferably in a range of 10 to 15, more preferably 12 to 14 or thereabouts.

The thickness of the third weight member is preferably 3 mm or less, e.g., 0.3 mm to 3 mm, more preferably 0.7 mm to 2.2 mm or thereabouts.

Although in the illustrated embodiment the third weight member 23 is embedded in the FRP 30, the third weight member 23 may be interposed between an edge portion of the metal sole portion 13 on the toe side and the FRP 30.

It should be noted that in the case where the metal body is formed of a titanium alloy, it is possible to use, in addition to the aforementioned ones, stainless steel, a copper alloy, lead, or the like as the weight members or a powder thereof.

The first weight member 21 may be secured to the annular member 18 by soldering or welding.

The weight of the first weight member 21 is preferably 30 g or less, more preferably in a range of 3 g to 20 g or thereabouts.

The weight of the second weight member 22 is preferably in a range of 2 g to 30 g, more preferably 5 g to 25 g or thereabouts.

The weight of the third weight member 23 is preferably in a range of 1 g to 20 g, more preferably 2 g to 18 g or thereabouts.

Assuming that the overall length (a maximum length in the front-and-rear direction in a projection drawing in which the golf club head is projected onto a horizontal plane with the golf club head placed thereon) of the golf club head is L, the position of the center of gravity of the first weight member 21 is preferably located in a range of 85% to 97%, more preferably 87% to 96%, of L from the front edge. The position of the center of gravity of the second weight member 22 is preferably located in the range of 5% to 95%, more preferably 7% to 94%, of L from the front edge. The position of the center of gravity of the third weight member 23 is preferably located in the range of 3% to 30%, more preferably 5% to 28%, of L from the front edge.

Assuming that a half of the maximum width (a maximum length in the toe-heel direction in the aforementioned projection drawing) of the golf club head is W, a distance between the position of the center of gravity of the second weight member 22 and the center line extending in the front-and-rear direction of the golf club head is preferably in a range of 50% to 80%, more preferably 52$ to 78% of W.

Assuming that a maximum thickness of the golf club head, i.e., a maximum value of a distance between the sole face and the crown portion, is H, the height of the center of gravity of the third weight member 23 from the lowest portion of the sole face is preferably located in a range of 5% to 40% or less, more preferably 8% to 37%, of H.

As a prepreg used to form the FRP body 30 and the like, it is possible to use any one of a cloth fiber prepreg, a unidirectional fiber prepreg, and the like. In a case where an SMC prepreg is used as this prepreg, it is possible to easily form the thin-walled FRP body 30. In addition, it is possible to adjust the weight by adding metal powder or the like into the resin of the prepregs, and adjust the position of the center of gravity by using some prepregs.

The FRP body 30 is preferably formed by laminating three to eight prepregs or thereabouts.

As fibers in the prepreg, carbon fibers or the like having a modulus of elasticity of $20\times10^3$ kg/mm$^2$ to $30\times10^3$ kg/mm$^2$ or thereabouts are preferable, but the invention is not limited thereto.

The elastic modulus of the crown portion in the front-and-rear direction can be made lower than that in the toe-heel direction by adjusting the orientation of these fibers. For example, the cloth fiber prepregs and the unidirectional fiber prepregs are alternately laminated, and the direction of orientation of the fibers of the unidirectional fiber prepregs is set as the toe-heel direction.

A thermosetting resin such as epoxy can be used as the resin of the FRP body 30. It should be noted that a small amount of thermoplastic resin may be compounded with this thermosetting resin, thereby making it possible to improve the vibration absorbing property.

The thickness of the FRP body 30 is preferably in a range of 1 mm to 3 mm. In particular, the thickness of the crown portion is preferably in a range of 1 mm to 2 mm, especially 1 mm to 1.5 mm, e.g., approximately 1.3 mm or thereabouts.

This golf club head 1 is easy to swing since the weight of the FRP body 30 is appropriate. In addition, since the depth of the center of gravity is deep and the second and third weight members 22 and 23 are provided, the sweet area in the toe-heel direction is large. Further, the degree of freedom in designing arrangement of the center of gravity is large. Since the third weight member 23 is embedded in the FRP 30, the aesthetic appearance is excellent. The first weight member 21 is also covered with the metal plate 26, so that the aesthetic appearance is excellent. It should be noted that a resin may be used instead of the metal plate 26.

Figure 9:
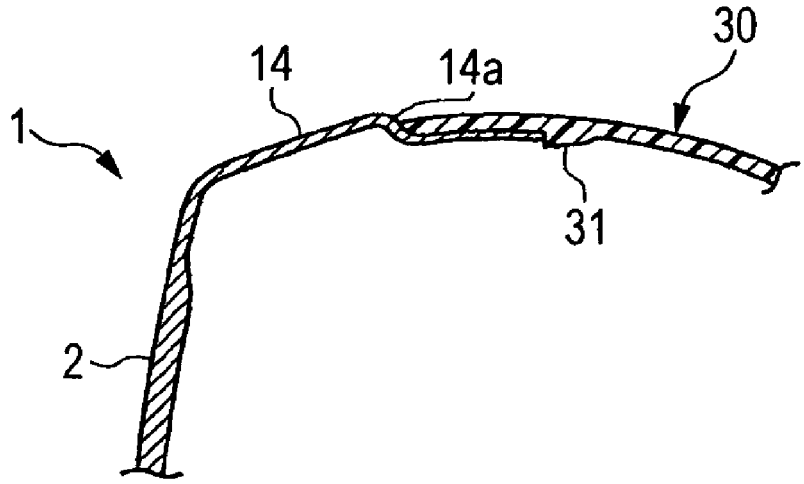
FIG. 9 is a section view illustrating another embodiment.
Figure 10:
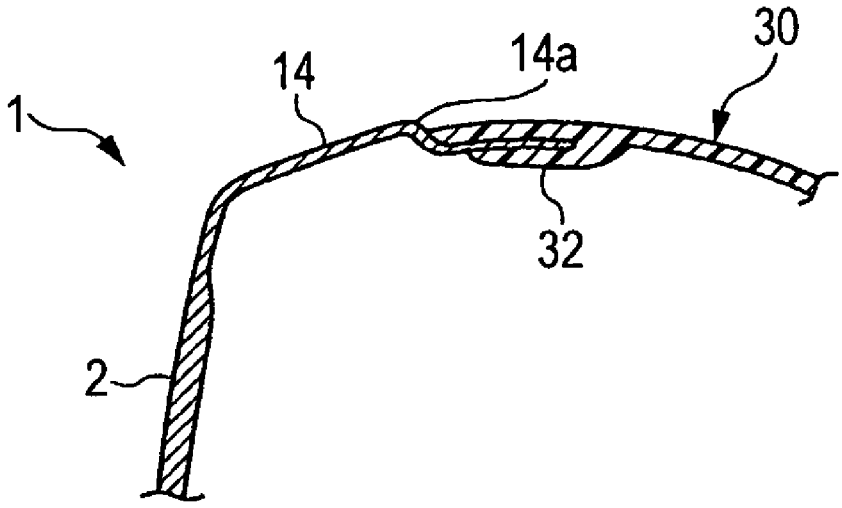
FIG. 10 is a section view illustrating still another embodiment.
Figure 11:
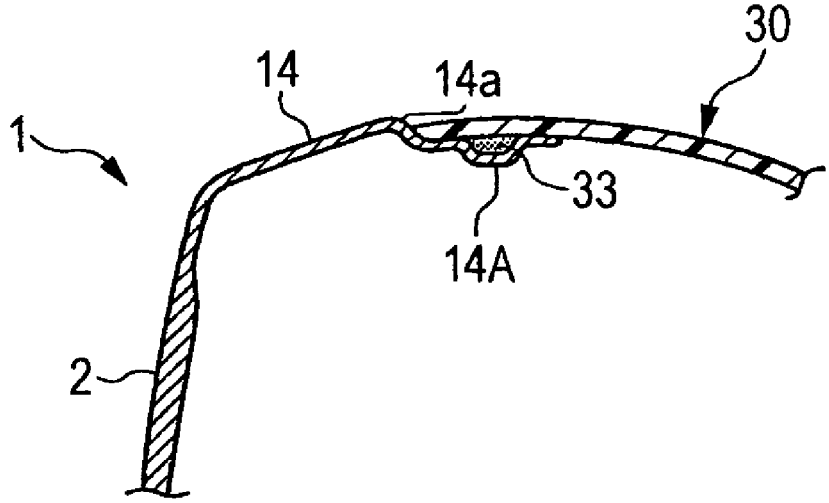
FIG. 11 is a section view illustrating a further another embodiment.

In the invention, it is possible to adopt structures as shown in FIGS. 9, 10, and 11 to enhance the bonding strength between the FRP body 30 and the metal body 10.

In FIG. 9, a protruding portion 31 abutting against an end face of the metal body 10 (in this case, the metal side portion 14) is provided on the inner surface of the FRP body 30.

In FIG. 10, an overlay portion 32 clamping an end of the metal body 10 (in this case, the metal side portion 14) is provided on the inner surface of the FRP body 30.

In FIG. 11, a recess 14A is provided in the metal body 10 (in this case, the metal side portion 14), and an adhesive agent 33 is filled in this recess 14A, thereby bonding the FRP body 30 and the metal side portion 14 together.

What is claimed is:

1. A hollow golf club head comprising:

a face portion;

a sole portion;

a side portion;

a crown portion; and a hosel portion, wherein:

a main portion of the crown portion is made of a fiber plastic resin, at least the face portion, a front edge portion of the crown portion continuous with the face portion, and a central portion of the sole portion in a toe-heel direction are made of a metal, a front edge portion of the side portion and a front edge portion of the sole portion are made of a metal and are continuous with the face portion, a metal portion of the sole portion extends to a rear face portion of the golf club head, a first weight member made of a metal is disposed at a rear portion thereof;

a loft angle is in a range of 14° to 25°, a head volume is in a range of 100 cc to 230 cc, and a weight of a fiber plastic resin portion of the golf club head is in a range of 6% to 30% of a weight of the golf club head.

2. The golf club head according to claim 1, wherein a weight of the first weight member is in a range of 10% to 25% of the weight of the golf club head.

3. The golf club head according to claim 1, wherein a sole-face side of the first weight member is covered with a metal or a resin.

4. The golf club head according to claim 1, wherein a second weight member is disposed on an inner surface of the metal portion of the sole portion, is in front of the first weight member, and is closer to a toe side than a halfway portion of the sole portion in the toe-heel direction.

5. The golf club head according to claim 1, wherein a third weight member is disposed inside the fiber plastic resin portion on a toe side or is disposed to be in contact with the fiber plastic resin portion.

6. The golf club head according to claim 5, wherein the third weight member has a thin-plate shape and is embedded in the fiber plastic resin constituting the side portion on the toe side.

7. The golf club head according to claim 6, wherein the third weight member is made of a rubber or a synthetic resin containing powder of a metal.

8. The golf club head according to claim 1, wherein:

the metal portion constituting the golf club head is formed of a face plate made by forging or press molding, a remaining portion of the golf club head is formed of a forged piece, and the face plate is fixed to the forged piece.

9. The golf club head according to claim 8, wherein a thickness of the face plate in a vicinity of a central portion of thereof is larger than that of a peripheral edge portion thereof.

10. The golf club head according to claim 1, wherein the weight of the golf club head is in a range of 215 g to 240 g.

11. The golf club head according to claim 1, wherein the metallic portion of the sole portion rises obliquely at the rear face portion of the club head.

* * * * *